US006478112B2

(12) United States Patent
Lee

(10) Patent No.: US 6,478,112 B2
(45) Date of Patent: Nov. 12, 2002

(54) RAIL MOUNTED FALL ARREST ASSEMBLY

(75) Inventor: David C. Lee, Houston, TX (US)

(73) Assignee: Protecta International, Inc., Houston, TX (US)

( * ) Notice: Subject to any disclaimer, the term of this patent is extended or adjusted under 35 U.S.C. 154(b) by 0 days.

(21) Appl. No.: 09/754,712

(22) Filed: Jan. 4, 2001

(65) Prior Publication Data

US 2002/0084140 A1 Jul. 4, 2002

(51) Int. Cl.[7] ..... E04G 3/14; A47L 3/04
(52) U.S. Cl. ..... 182/36; 182/3; 248/228.5
(58) Field of Search ..... 182/36, 3; 248/228.5, 248/228.1, 229.14, 231.61

(56) References Cited

U.S. PATENT DOCUMENTS

| | | | | | |
|---|---|---|---|---|---|
| 1,646,244 | A | * | 10/1927 | Hassler | 248/228.4 X |
| 2,765,139 | A | * | 10/1956 | White | 248/228.1 X |
| 2,907,506 | A | * | 10/1959 | Sammons | 248/229.14 X |
| 2,944,781 | A | * | 7/1960 | Masters | 248/228.5 |
| 3,217,833 | A | * | 11/1965 | Smith | 182/3 |
| 3,763,794 | A | * | 10/1973 | Fleck | 248/231.61 X |
| 4,767,091 | A | * | 8/1988 | Cuny | 182/3 X |
| 5,526,896 | A | | 6/1996 | O'Rourke | 182/3 |
| 6,053,279 | A | * | 4/2000 | McKenna | 182/36 |

OTHER PUBLICATIONS

U.S. application Ser. No. 09/692,642, Austin, filed Oct. 19, 2000.

* cited by examiner

*Primary Examiner*—Daniel P. Stodola
*Assistant Examiner*—Hugh B. Thompson
(74) *Attorney, Agent, or Firm*—IPLM Group, P.A.

(57) ABSTRACT

A sliding rail anchor fall arrest system (20) includes an anchor assembly (22), a safety hook (24), a safety harness (26) worn by a worker and a flexible lanyard (28) extending between the hook (24) and the harness (26). The sliding rail anchor assembly (22) includes a pair of anchor members (23) that cooperate to slidably engage a crown (29) of a rail (30) or other elongate member being used as an anchor point for fall arrest purposes. Each anchor subassembly (23*a* and 23*b*) includes a rail engaging portion (34 and 40) and a connector portion (35 and 41). When the rail engaging portions (34 and 40) are positioned around the crown (29), a cavity is formed to envelope the crown (29) thereby allowing longitudinal movement along the rail (30) but little to no movement transversely along the rail (30) by the anchor assembly (22). The connector portions (35 and 41) are configured and arranged to mate with one another, and to accommodate a hook (24) that is received by at least one connector portion (35 and 41) thereby locking the anchor members (23) securely together.

7 Claims, 2 Drawing Sheets

RAIL MOUNTED FALL ARREST ASSEMBLY

BACKGROUND OF THE INVENTION

1. Field of the Invention

The present invention relates generally to fall arrest systems, and more particularly to fall arrest systems of the type having an anchor that are movable along a rail, e.g. a railway rail.

2. Description of the Prior Art

Fall arrest systems are well known. Such systems typically include an anchor secured to a support structure or other anchor point in the work area, a safety harness worn by the worker, and a flexible lanyard interconnecting the anchor to the harness. A fall arrest system permits the worker wearing the harness to safely work in areas where he or she is subjected to the risk of falling. The fall arrest system permits the worker to conduct his or her tasks without undue interference, but should the worker fall, the system quickly and safety arrests the fall.

One type of fall arrest system includes an anchor that is movably mounted on a fixed rail, e.g. the rail of a locomotive railway. In this case, the anchor is designed to freely slide or roll along the rail so as to permit the worker to freely move along the rail to, for example, conduct maintenance activities on the railway or on a railway bridge. The anchor can slide along the rail by engaging the rail in such a way as to permit sliding in a longitudinal direction along the rail but at the same time preventing the anchor from separating from the rail or moving in a transverse direction relative to the rail. And, of course, the anchor is securely connected to the worker by means of a safety hook, a lanyard, and a harness.

One example of a prior art sliding rail anchor fall arrest system is disclosed in U.S. Pat. No. 5,526,896 to O'Rourke. The O'Rourke anchor includes a pair of formed metal plates each comprising an upper flat portion and a lower curved portion. The flat portions abut together and the curved portions capture and slidably engage the crown of a rail. The flat portion of each plate forms three apertures, the middle of which receives a safety hook, and the outer two of which receive threaded fasteners for holding the abutting flat portions together. One of the outer apertures on each anchor plate is elongated and has a smaller end and a larger end. The flat plates are assembled by loosely attaching the threaded fasteners to the plates; abutting the plate flat portions together so that the larger ends of the elongated holes receive the bolt heads; and longitudinally sliding one plate relative to the other plate so that the bolts then reside in the smaller ends of the elongated apertures. Once the two flat portions are slid together in this fashion, the threaded fasteners can then be tightened to adjust the fit between the anchor and the rail, establishing anything from a loose sliding fit to having the anchor actually clamped to the rail thus permitting no longitudinal movement of the anchor whatsoever.

While the O'Rourke anchor would appear to be generally useful for its intended purpose, it is perceived that it may have some disadvantages. For one thing, the O'Rourke design requires that the workers have the tools and the patience to properly adjust the fit between the anchor and the rail. Also, friction between the flat abutting portions of the plates may hinder the sliding assembly of the plates, especially if there is any corrosion, debris, ice, gravel, etc. therebetween. In addition, it may be difficult to assemble the plates and adjust the tightness of the threaded fasteners when the workers are wearing heavy work gloves or when there is inadequate light. There is also the possibility, however remote, that the fasteners will be loosened excessively, to accommodate the sliding assembly of the plates, thereby potentially increasing the likelihood that the fasteners will become disengaged from the plates.

In further reference to the O'Rourke design, since the elongated apertures must be oriented in the same direction once the plates are abutted, i.e. with both of the larger ends pointed toward a first end of the plates when the plates face one another, a disadvantage of the O'Rourke design is that the two plates are not mirror images of one another, at least with regard to the elongated apertures, thus requiring each plate to be separately manufactured and stocked. In other words, room for improvement remains.

SUMMARY OF THE INVENTION

A preferred embodiment fall arrest anchor assembly suitable for operatively engaging a rail includes a first member, a second member, and a hook. The first member includes a rail engaging portion and a connector portion having a slot. The second member includes a rail engaging portion and a connector portion having a hole. Each rail engaging portion is configured and arranged to operatively engage a respective side of a rail, and the hook is inserted through the slot and secured relative to the hole.

Another preferred embodiment fall arrest anchor assembly suitable for operatively engaging a rail includes a first member, a second member, and a hook. The first member includes a rail engaging portion and a U-shaped connector portion having a slot. The second member includes a rail engaging portion and a connector portion having a hole. Each rail engaging portion is configured and arranged to operatively engage a respective side of a rail, and the hook is inserted through the slot and secured relative to the hole.

DETAILED DESCRIPTION OF THE PREFERRED EMBODIMENT

Figure 1:
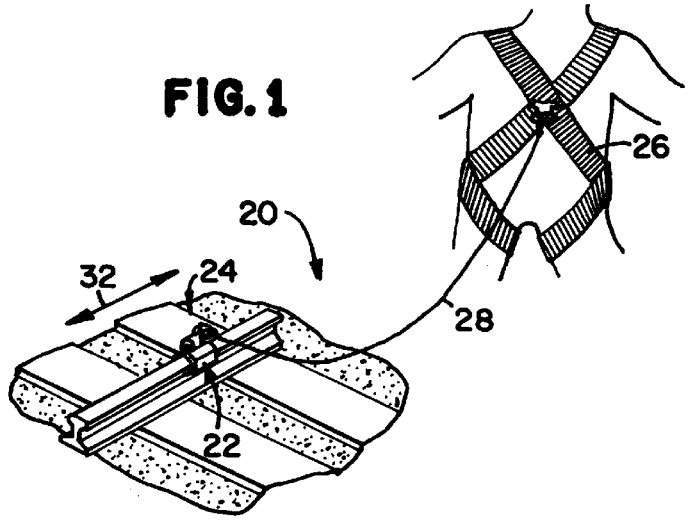
FIG. 1 is a perspective view of a fall arrest system constructed according to the principles of the present invention and mounted to a standard railway rail.

With reference to the drawings, wherein like reference numerals designate like parts and assemblies throughout the several views, a rail mounted fall arrest assembly constructed according to the principles of the present invention is designated by the numeral 20 in FIGS. 1–5.

The present invention relates to a sliding rail anchor fall arrest system. It should be noted, however, that the term "sliding," when referring to the permitted movement of the anchor longitudinally along the rail, is used broadly to refer to any sort of fit or connection between the anchor and the rail which permits relatively low friction movement longitudinally along the rail. That is, the term "sliding," when used in this context, is not limited to any particular anchor/rail interconnection or fit, except to the extent that the anchor can relatively easily move along the rail in a direction parallel to the longitudinal axis of the rail. Furthermore, the term "rail," as used herein, is not necessarily limited to the rail of a locomotive railway. Rather, the term "rail" is intended to refer to any elongate structural member to which a worker could attach a "'sliding" anchor assembly according to the principles of the present invention in the context of a sliding anchor fall arrest system.

Figure 4:
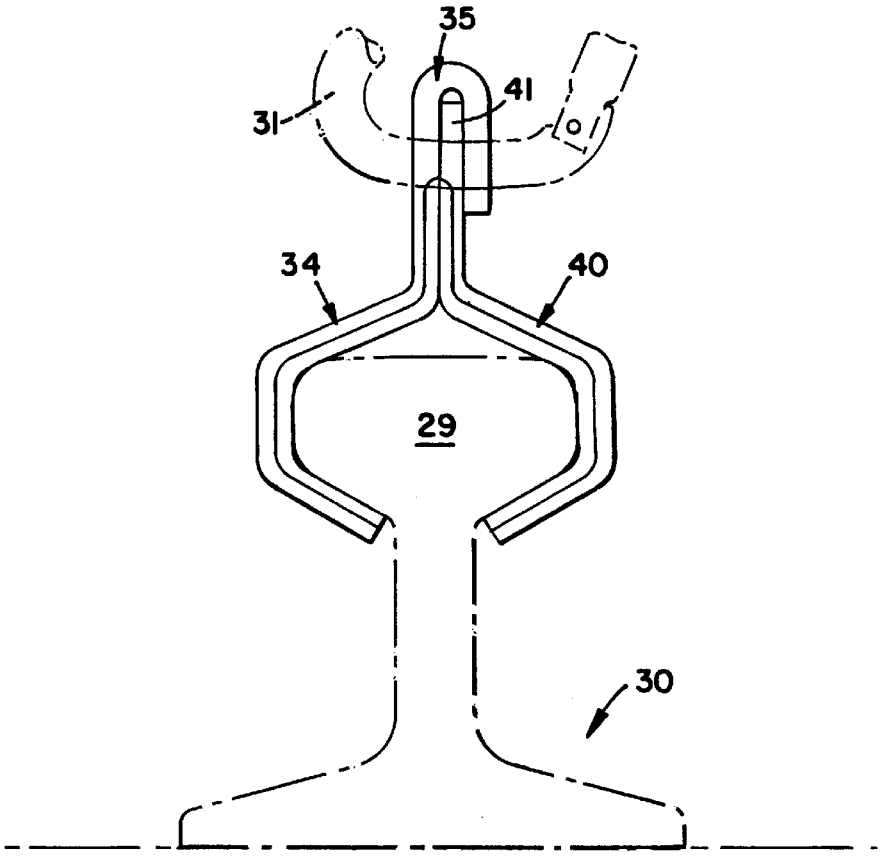
FIG. 4 is an end view of the anchor assembly of FIG. 2 mounted on a crown portion of a ray rail and receiving a safety hook.

FIG. 1 illustrates a preferred embodiment rail mounted fall arrest assembly 20 in accordance with the present invention. Fall arrest assembly 20 includes an anchor assembly 22, a safety hook or carabiner 24, a safety harness 26 worn by a worker, and a flexible lanyard 28 securing the safety harness 26 to the safety hook 24. In the preferred embodiment, anchor assembly 22 is sized and configured to engage the crown 29 of a railway rail 30, as shown in FIG. 4, in such a way that anchor assembly 22 can slide longitudinally along the rail 30 while preventing anchor assembly 22 from moving in a direction transverse to the rail 30. That is, anchor assembly 22 can slide along the rail 30 as indicated by arrow 32 in FIG. 1, but cannot move in any other direction, i.e. in any "transverse" direction, relative to the rail 30.

Figure 2:
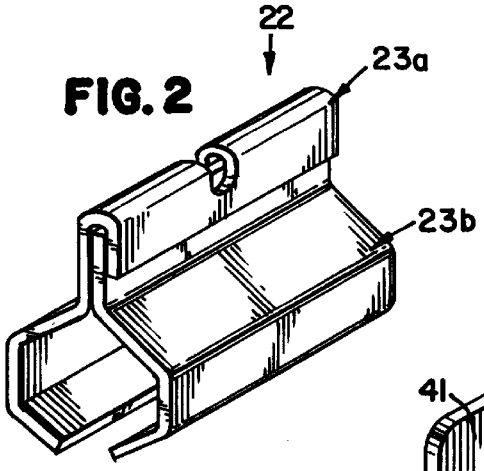
FIG. 2 is a perspective view of an anchor assembly portion of the fall arrest system of FIG. 1.
Figure 3:
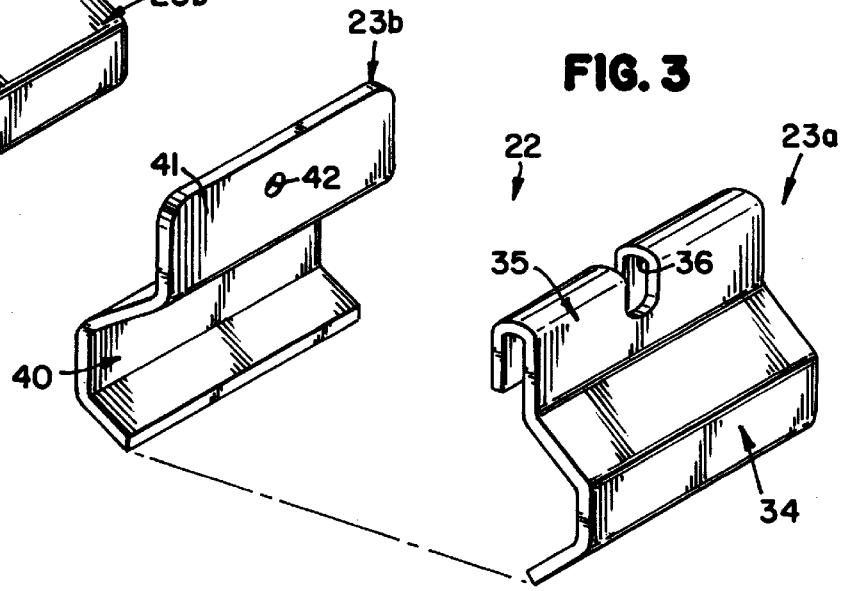
FIG. 3 is an exploded perspective view of the anchor assembly of FIG. 2.

With particular reference to FIGS. 2 and 3, preferred anchor assembly 22 consists of a pair of anchor halves or members 23. One anchor member may be described as first member 23*a* and the other anchor member may be described as second member 23*b*. First member 23*a* includes a generally C-shaped rail engaging portion 34, a generally U-shaped connector portion 35, and a hook accommodating slot 36 in the center of the connector portion 35. Second member 23*b* includes a generally C-shaped rail engaging portion 40, a planar connector portion 41, and a hook receiving aperture 42 in the center of the connector portion 41.

Each rail engaging portion 34 and 40 is three-sided and is configured and arranged to conform to a respective side of the crown 29 of rail 30, as shown in FIG. 4. Each connector portion 35 and 41 is integrally connected to a distal edge of a respective rail engaging portion 34 or 40 and extends upward from the rail 30. Preferably, the connector portion 35 is substantially U-shaped (when viewed from the end) and has a rectangular profile when viewed from the side, and the connector portion 41 is substantially flat (when viewed from the end) and has a similar rectangular profile when viewed from the side. Moreover, the flat rectangular portion of the connector portion 41 fits within a channel defined by the U-shaped rectangular portion of the connector portion 35. That is, connector portion 35 envelopes connector portion 41 when rail engaging portions 34 and 40 are placed along opposite sides of the rail 30 and slid into alignment with one another. When the members 23*a* and 23*b* are properly aligned, the slot 36 aligns with the hole 42 to facilitate insertion of a fastener through both. Anchor members 23 are preferably made of steel, 0.25 inch thick gauge, which has been formed using conventional manufacturing processes. The "leading" and "trailing" edges of rail engaging portions 34 and 40 are preferably chamfered to make it easier to longitudinally slide the anchor assembly 22 along rail 30.

FIG. 4 shows the preferred three-sided shape of the rail engaging portions 34 and 40 and how they are sized and configured to conform to the crown 29 of rail 30. Those skilled in the art will recognize that the rail engaging portions 34 and 40 could have alternative shapes and sizes, depending upon the specifics of the rail on which the anchor assembly is designed to slidably engage. Also, it is to be understood that the inner dimensions of the cavity formed by the cooperating rail engaging portions 34 and 40 are slightly larger than the outer dimensions of the crown 29 to create a sliding fit therebetween. Again, any type of fit or system, including without limitation one that uses bearings between the anchor members 23 and the rail 30, would fall within the term "sliding" as used herein.

Each of the anchor members 23 has an inboard side facing inwardly toward the rail (visible only on the member 23*b* in FIG. 3) and an outboard side facing outwardly (visible only on the member 23*a* in FIG. 3). Thus, when anchor assembly 22 is assembled, the inboard sides of the rail engaging portions 34 and 40 form a cavity that envelopes crown 29 of rail 30.

Figure 5:
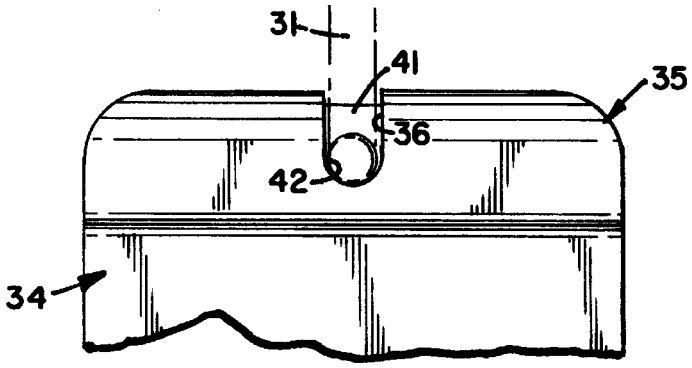
FIG. 5 is a partial side elevational view of the anchor assembly of FIG. 2.

In operation, the anchor members 23 are first located on either side of the crown 29 of rail 30 so their inboard sides form a cavity that will envelope the rail 30 when assembled, as shown generally in FIG. 4 in their assembled state. Then, the anchor members 23 are moved toward one another and connector portion 35 of first member 23*a* receives connector portion 41 of second member 23*b* so that the hook receiving slot 36 is aligned and in communication with the hook receiving aperture 42. Although the hook 31 is only threaded through the hook receiving aperture 42, as shown in FIG. 5, the mating of connector portions 35 and 41 and the location of the hook accommodating slot 36 proximate the hook engaging aperture 42 operatively connect the two anchor members 23 when the hook 31 is placed through hook engaging aperture 42. Once the anchor members 23 are attached by hook 31, the rail engaging portions 34 and 40 act together to form a cavity sized precisely to permit the appropriate sliding fit with the crown 29 of rail 30, thus requiring no additional adjustments by the workers. Therefore, the assembly and disassembly of the anchor assembly 22 is relatively quick and easy.

In the most preferred embodiment, the anchor members 23 are made of ¼ inch thick A36 steel that is zinc coated to resist corrosion. The anchor members 23 are preferably about 6 inches long, measured along the longitudinal direction, and about 5 inches tall after forming. The hook receiving aperture 42 is preferably about 3 inches long in the longitudinal direction and about ½ inches wide. This renders it suitable to accept standard safety hooks or carabiners.

Preferred embodiments of the present invention are described above. Those skilled in the art will recognize that other embodiments are possible within the scope of the invention. Variations and modifications of the various parts and assemblies can certainly be made and still fall within the scope of the invention.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A fall arrest anchor assembly suitable for operatively engaging a rail, the fall arrest anchor assembly being slidable along the rail, consisting essentially of:

a. a first member having a rail engaging portion and a connector portion including a slot, said connector portion extending upwardly from said rail engaging portion;

b. a second member having a rail engaging portion and a connector portion including a hole, said connector portion extending upwardly from said rail engaging portion, each said rail engaging portion being configured and arranged to operatively engage a respective side of a rail and being slidable along the rail, wherein said connector portion of said first member is configured and arranged to engage said connector portion of said second member wherein said connector portion of said first member is U-shaped to envelope said connector portion of said second member;

c. a hook inserted through said slot and secured relative to said hole thereby securing said connector portions of said first and second members;

d. a safety harness; and e. a lanyard, said lanyard interconnecting said hook and said harness.

2. The fall arrest anchor assembly of claim 1, wherein said rail engaging portion of one anchor member is substantially a mirror image of said rail engaging portion of the other anchor member.

3. The fall arrest anchor assemble of claim 2, wherein said rail engageing portion extends longitudinally along said rail.

4. A fall arrest anchor assembly suitable for operatively engaging a rail, the fall arrest anchor assembly being slidable along the rail, comprising:

a. a first member having a rail engaging portion and a U-shaped connector portion including a slot, said U-shaped connector portion extending upwardly from said rail engaging portion;

b. a second member having a rail engaging portion and a planar connector portion including a hole, said planar connector portion extending upwardly from said rail engaging portion, each said rail engaging portion being configured and arranged to operatively engage a respective side of a rail and being slidable along the rail, said planar connector portion fitting within said U-shaped connector portion;

c. a hook inserted through said slot and secured relative to said hole thereby securing said U-shaped connector portion and said planar connector portion;

d. a safety harness; and e. a lanyard, said lanyard interconnecting said hook and said harness.

5. The fall arrest anchor assembly of claim 4, wherein said rail engaging portion of one anchor member is substantially a mirror image of said rail engaging portion of the other anchor member.

6. The fall arrest anchor assembly of claim 5, wherein said rail engaging portion extends longitudinally along said rail.

7. A fall arrest anchor assembly suitable for operatively engaging a rail and for use with a safety harness, the fall arrest anchor assembly being slidable along the rail, comprising:

a. a first member having a rail engaging portion and a U-shaped connector portion including a channel and a slot, said slot being located within said channel, said connector portion extending upwardly from said rail engaging portion;

b. a second member having a rail engaging portion and a planar connector portion including a hole, said hole corresponding with said slot of said U-shaped connector portion, said connector portion extending upwardly from said rail engaging portion, each said rail engaging portion being configured and arranged to operatively engage a respective side of a rail and being slidable along the rail, said planar connector portion fitting within said channel of said U-shaped connector portion;

c. a hook inserted through said slot and secured relative to said hole thereby securing said U-shaped connector portion and said planar connector portion;

d. a safety harness; and e. a lanyard, said lanyard interconnecting said hook and said harness.

* * * * *

UNITED STATES PATENT AND TRADEMARK OFFICE

CERTIFICATE OF CORRECTION

PATENT NO. : 6,478,112 B2
DATED : November 12, 2002
INVENTOR(S) : David C. Lee

It is certified that error appears in the above-identified patent and that said Letters Patent is hereby corrected as shown below:

Title page,
Item [57], ABSTRACT,
Line 3, please insert -- , -- after "worker"

Column 2,
Line 46, please delete "ray rail" and insert therefore -- railway --

Column 5,
Line 17, please delete "assemble" and insert therefore -- assembly --

Signed and Sealed this

Twenty-ninth Day of July, 2003

JAMES E. ROGAN
*Director of the United States Patent and Trademark Office*